US007575027B2

(12) United States Patent
Huang

(10) Patent No.: US 7,575,027 B2
(45) Date of Patent: Aug. 18, 2009

(54) WEAVE WITH VISUAL COLOR VARIATION

(76) Inventor: Min-San Huang, No. 13, Lane 721, Zhongzheng Rd., Xinzhuang City, Taipei County (TW)

( * ) Notice: Subject to any disclaimer, the term of this patent is extended or adjusted under 35 U.S.C. 154(b) by 0 days.

(21) Appl. No.: 11/649,904

(22) Filed: Jan. 5, 2007

(65) Prior Publication Data

US 2008/0163952 A1 Jul. 10, 2008

(51) Int. Cl.
*D03D 13/00* (2006.01)
*D03D 25/00* (2006.01)

(52) U.S. Cl. ..... 139/420 R; 139/426 R

(58) Field of Classification Search ..... 139/420 R, 139/426 R, 383 R, 391, 394; 2/2.5
See application file for complete search history.

(56) References Cited

U.S. PATENT DOCUMENTS 1,139,705 A * 5/1915 Murch ..... 139/427
1,821,504 A * 9/1931 Feiler ..... 139/420 R
1,908,328 A * 5/1933 Dreyfus ..... 139/426 R
1,910,850 A * 5/1933 Millen ..... 139/420 R
2,059,285 A * 11/1936 Sexton et al. ..... 57/235
2,087,389 A * 7/1937 Stark ..... 139/420 R
2,106,457 A * 1/1938 Hyman ..... 139/420 R
2,312,089 A * 2/1943 Gobeille ..... 139/420 R
2,772,994 A * 12/1956 Lacy ..... 428/203
2,937,668 A * 5/1960 Carey, Jr. et al. ..... 139/426 R
2,958,923 A * 11/1960 Fischer et al. ..... 112/400
3,069,746 A * 12/1962 Scharf ..... 442/185
3,508,589 A * 4/1970 Derick et al. ..... 139/420 R
3,642,561 A * 2/1972 Grobner ..... 428/102
3,801,183 A * 4/1974 Sevelin et al. ..... 359/537
3,802,944 A * 4/1974 Tung ..... 428/143
3,849,159 A * 11/1974 Palmer et al. ..... 8/497
3,934,065 A * 1/1976 Tung ..... 428/76
3,964,824 A * 6/1976 Dixon ..... 359/710
4,087,156 A * 5/1978 Kao et al. ..... 385/46
4,244,369 A * 1/1981 McAvinn et al. ..... 604/362
4,336,092 A * 6/1982 Wasserman ..... 156/269
4,352,380 A * 10/1982 Owen et al. ..... 139/426 R
4,397,142 A * 8/1983 Bingham ..... 57/238
4,466,697 A * 8/1984 Daniel ..... 385/123
4,627,113 A * 12/1986 Lord ..... 2/144
4,954,976 A * 9/1990 Noonan ..... 703/6
5,417,754 A * 5/1995 Hester ..... 106/162.9
5,487,936 A * 1/1996 Collier ..... 442/214
5,560,401 A * 10/1996 Miglus ..... 139/383 R
5,741,590 A * 4/1998 Kobsa et al. ..... 428/373
6,603,551 B2 * 8/2003 Mestha et al. ..... 356/402
7,083,841 B2 * 8/2006 Oakey et al. ..... 428/88
2002/0191189 A1 * 12/2002 Mestha et al. ..... 356/402

(Continued)

*Primary Examiner*—Bobby H Muromoto, Jr.
(74) *Attorney, Agent, or Firm*—Schmeiser, Olsen & Watts LLP

(57) ABSTRACT

A weave with a visual color variation, is interlaced by a plurality of longitudinal yarns and a plurality of latitudinal yarns. One of the longitudinal yarns and latitudinal yarns includes at least one protruding yarn and two color yarns with different colors. The protruding yarn has a plurality of protruding portions presenting on the surface of the weave. The two color yarns are arranged beside the protruding yarn respectively, and the two color yarns have a plurality of color portions presenting on the surface of the weave respectively. If the weave is observed from different viewing angles, the color portions are interfered by the protruding portion to make the weave show various visual color variations.

16 Claims, 6 Drawing Sheets

U.S. PATENT DOCUMENTS

2003/0024093 A1* 2/2003 Willauer, Jr. ..... 28/160
2003/0031821 A1* 2/2003 Oakey et al. ..... 428/44
2004/0115882 A1* 6/2004 Hung et al. ..... 438/257
2006/0098286 A1* 5/2006 Sagar et al. ..... 359/530
2007/0122585 A1* 5/2007 Fukuro et al. ..... 428/85
2007/0202299 A1* 8/2007 Huang ..... 428/143

* cited by examiner

WEAVE WITH VISUAL COLOR VARIATION

BACKGROUND OF THE INVENTION

1. Field of the Invention

The present invention relates to weaves, and more particularly to a weave with a visual color variation observing from different viewing angles or changing position angles of the weave.

2. Description of the Related Art

To improve values and beauties of weaves, various diversifications by changing cooperation of longitudinal yarns and latitudinal yarns or changing designs of veins, such as diagonal, latticework, pattern, are produced on the weaves. In addition, the weaves can cooperate with colors to present its particular styles.

A conventional method uses materials which have a character of changing colors with changing temperatures or ultraviolet indexes in the weaves to make the weaves having the visual color variation.

However, the materials which have the character of changing colors with changing environmental conditions, are electronic bases. The costs of the materials are high, thereby, the weaves using those materials are in high costs. Furthermore, the weaves using the materials may pollute the environment.

What is needed, is to provide a weave with a visual color variation which can solve the above problems.

BRIEF SUMMARY

A weave with a visual color variation in accordance with a preferred embodiment is interlaced by a plurality of longitudinal yarns and a plurality of latitudinal yarns. One of the longitudinal yarns and latitudinal yarns includes at least one protruding yarn and two color yarns with different colors. The protruding yarn has a plurality of protruding portions presenting on the surface of the weave. The two color yarns are arranged beside the protruding yarn respectively, and the two color yarns have a plurality of color portions presenting on the surface of the weave respectively. If the weave is observed from different viewing angles, the color portions are interfered by the protruding portion to make the weave show various color variations.

If the protruding yarn is opaque, the color portions of the color yarns are shaded by the protruding portions of the protruding yarn so as to produce visual color variations observing from different viewing angles or various position angles of the weave. If the protruding yarn is transparent, the color portions of the color yarns are not shaded by the protruding portions of the protruding yarn, but the color portions are refracted by the protruding portions of the protruding yarn so as to produce visual color variations observing from different viewing angles or various position angles of the weave. Therefore, the weave will give a lively impression in vision.

Other objects, advantages and novel features of the invention will become more apparent from the following detailed description when taken in conjunction with the accompanying drawings, in which:

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Reference will now be made to the drawings to describe a preferred embodiment of the present weave with a visual color variation, in detail.

Figure 1:
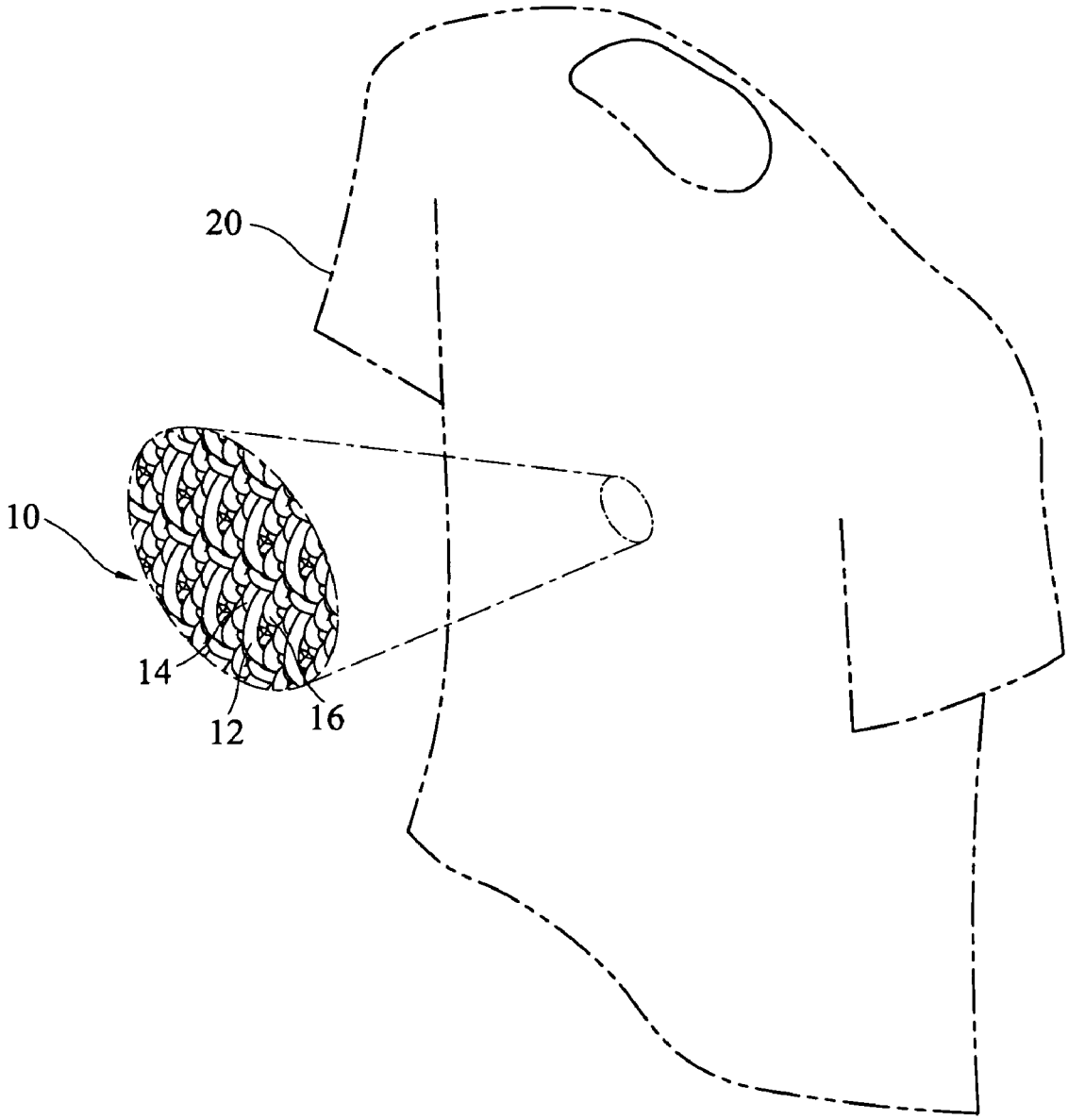
FIG. 1 is a schematic view of a cloth having a weave with a visual color variation in accordance with a first preferred embodiment of the present invention.

Referring to FIG.1, a (拒絕修訂) the cloth 20 is (拒絕加入) having a weave with a visual color variation in accordance with a first preferred embodiment of the present invention is shown. The cloth 20 may have a portion interlaced by a number of longitudinal yarns and a number of latitudinal yarns or the whole of the cloth 20 is interlaced by a number of longitudinal yarns and a number of latitudinal yarns. In a weaving procedure, some yarns are protruded upwards by a special design of the veins and some yarns with different colors are arranged beside the protruding yarns. In this illustrated embodiment, the weave 10 is weaved by a number of longitudinal yarns and a number of latitudinal yarns, and one of the longitudinal yarns and the latitudinal yarns has a protruding yarn 12 and two opposite color yarns 14, 16 arranged beside the protruding yarn 12.

Figure 2:
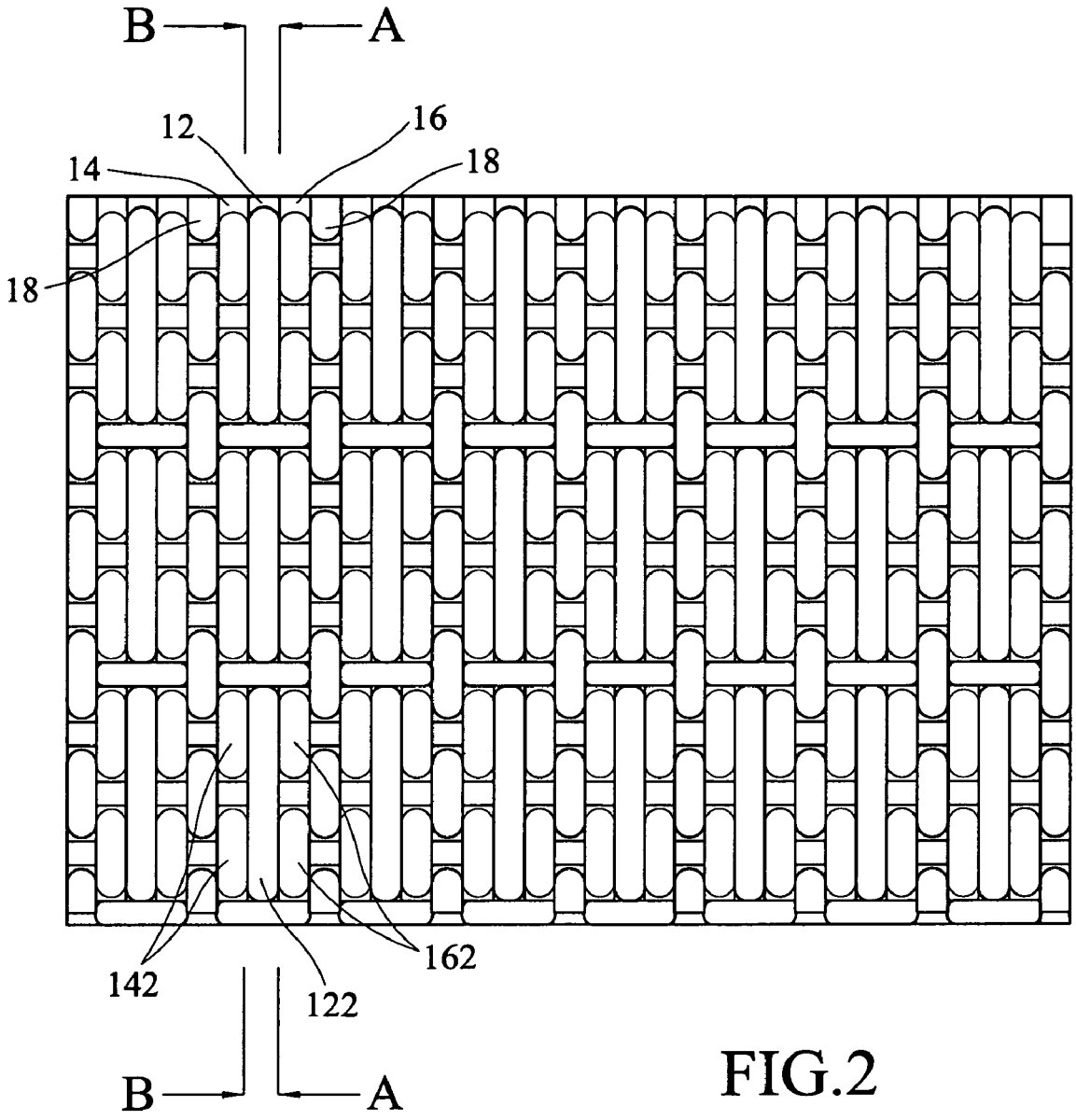
FIG. 2 is an enlarged front view of the weave of FIG. 1.

Referring to FIG. 2, the protruding yarn 12 includes a number of protruding portions 122 presenting on the surface of the weave. The protruding yarn 12 may be produced by the tensile force and the pulling force produced by corresponding yarns intersecting with the protruding yarn 12 so as to protrude and present on the surface of the weave 10.

Furthermore, the color yarns 14, 16 arranged beside the protruding yarn 12 are in different colors, and each one has a number of color portions 142, 162 presenting on the surface of the weave 10. In this illustrated embodiment, the protruding yarn 12 is an opaque white yarn, the left color yarn 14 arranged at the left side of the white protruding yarn 12 is a red yarn, and the right color yarn 16 arranged at the right side of the white protruding yarn 12 is a blue yarn. Therefore, the colors with at least white color, red color and blue color, are presented on the weave. Three colors portions are observed on the weave from vertical viewing angle when the weave is positioned at a flat plane. However, the weave has visual color variations if changing the viewing angle or changing the position angle of the weave.

A region with the visual color variation produced by the cooperation of the protruding yarn 12 and the color yarns 14, 16, is fitted with the design of the veins. The region with the visual color variation only occupies a partial of the weave, and the region may be an irregular region or a geometry pattern region. The region may cooperate with various designed patterns on the weave to achieve the visual color variations therein.

Furthermore, the weave 10 may include a number of combinatorial units produced by the protruding yarn 12, and the color yarns 14, 16. Furthermore, there is a separating yarn 18 to separate the protruding yarn 12 and the color yarns 14, 16.

Figure 3:
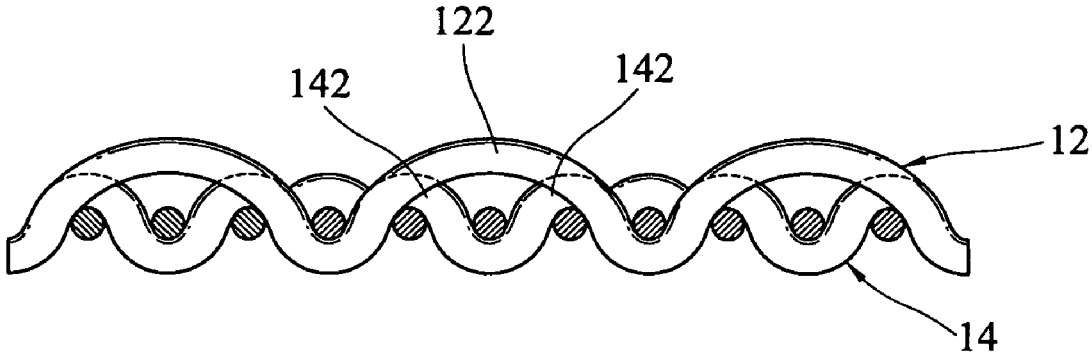
FIG. 3 is a crossed-section view of the weave of FIG. 2 along a line of A-A.
Figure 4:
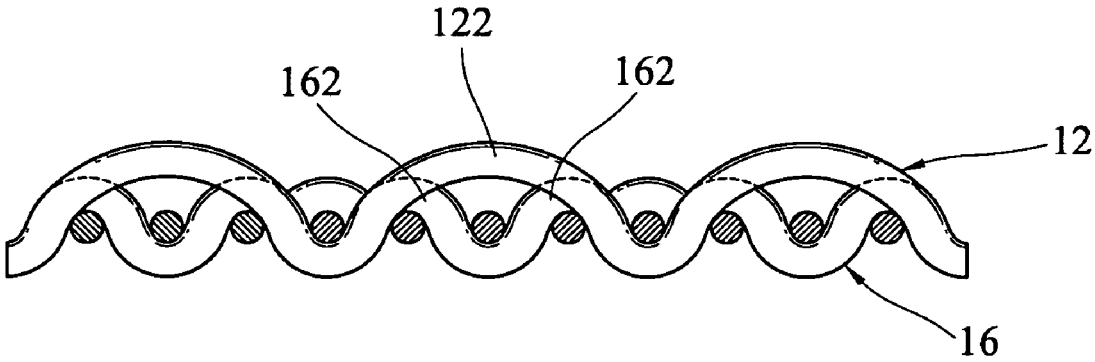
FIG. 4 is a crossed-section view of the weave of FIG. 2 along a line of B-B.

Referring to FIGS. 3 and 4, if the color portions 142, 162 arranged beside the protruding portion 122 are observed from a viewing angle described as the FIGS, the part or the whole of the color portions 142(or the color portions 162) is shaded by the protruding portion 122 so as not to be observed.

Figure 5A:
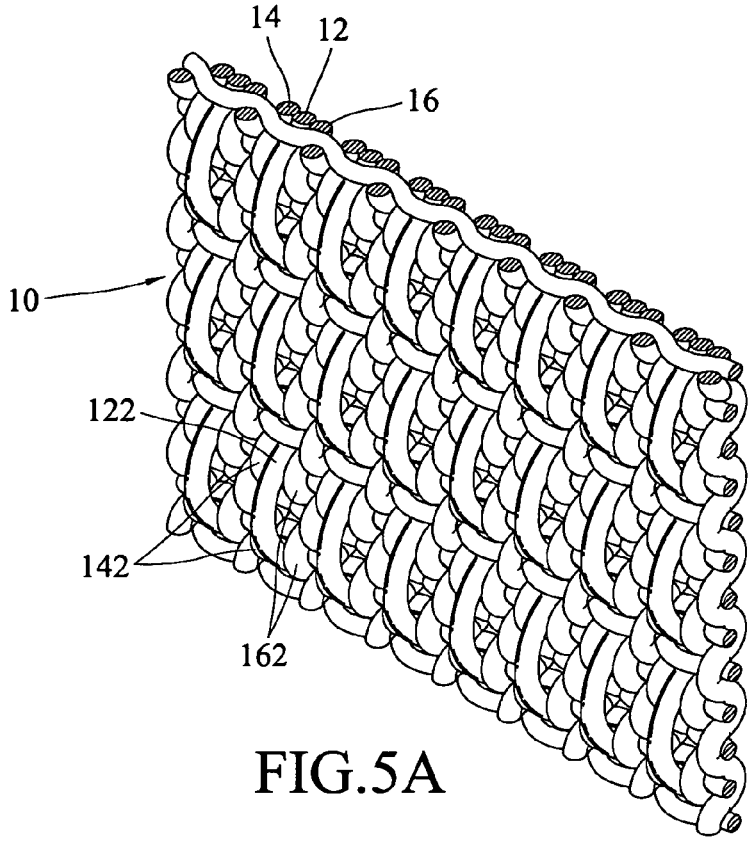
FIG. 5A is an exploded view of the weave of FIG. 2 from a viewing angle.

If the weave 10 is observed from a viewing angle described as FIG. 5A, each protruding portion 122 presenting on the surface of the weave, will shade the corresponding left color portion 142 which is arranged at the left side of the protruding portion 122. Thereby, the left color portion 142 is shaded partially or wholly. Only the protruding portion 122 and the right color portion 162 arranged at the right side of the protruding portion 122 can be observed. If the left color portion 142 is shaded partially by the protruding portion 122, the part of the left color portion 142 may be observed, but it has an evident difference in visual effects compared with the right color portion 162 arranged at the right side of the protruding portion 122. The evident difference may change with the viewing angle changing.

Figure 5B:
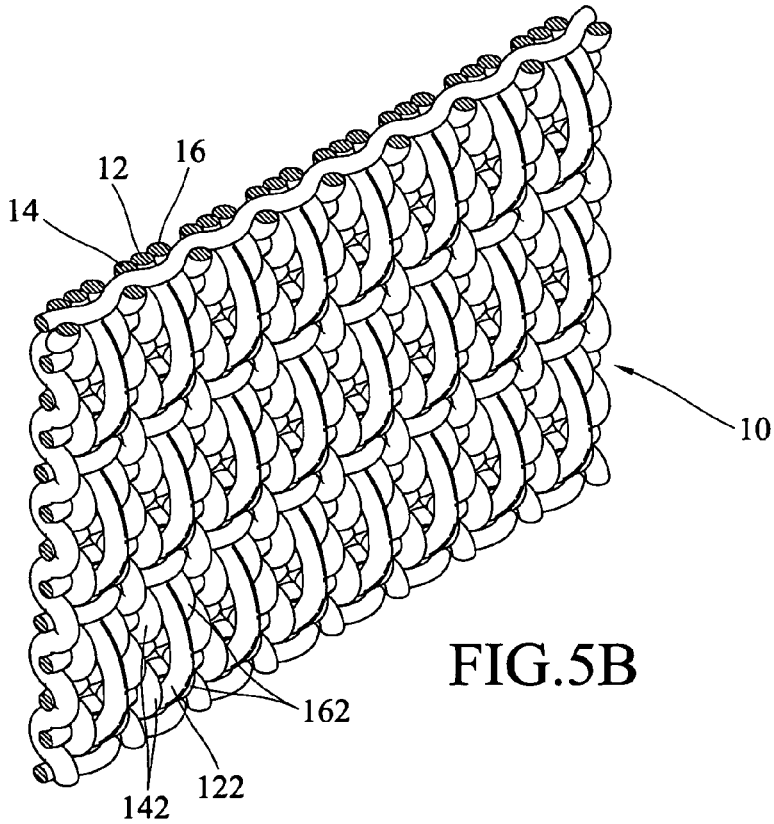
FIG. 5B is an exploded view of the weave of FIG. 2 from another viewing angle.

If the weave 10 is observed from a viewing angle described as FIG. 5B, each protruding portion 122 may shade the right color portion 162 arranged at the right side so that the right color portion 162 may be shaded partially or wholly. Therefore, only the protruding portion 122, the left color portion 142 arranged at the left side of the protruding portion, and the part of the right color portion 162 which is not shaded, can be observed.

Figure 6:
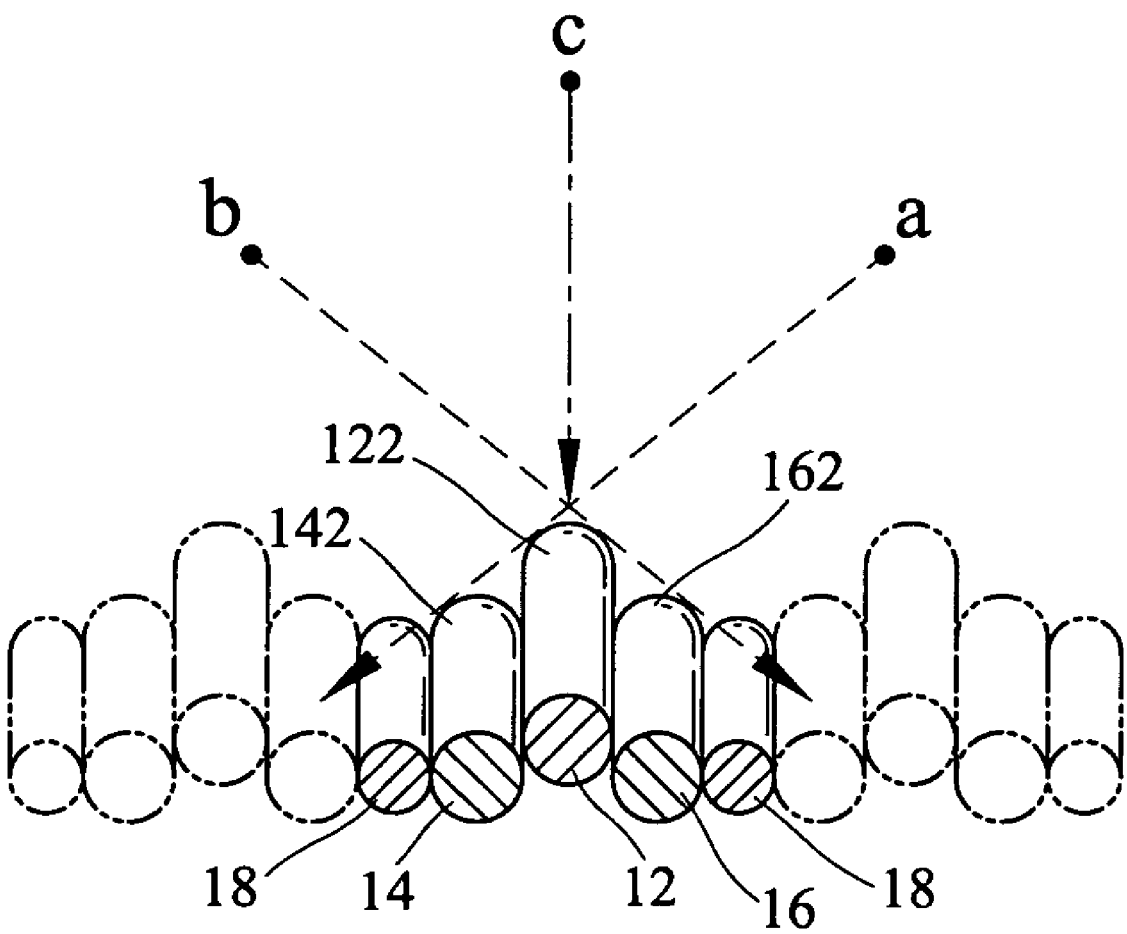
FIG. 6 is a side view of the weave of FIG. 2.

Referring to FIG. 6, a side view of the weave is shown. In FIG. 6, a point "c" direction is a perpendicular viewing angle to the surface of the weave; points "a" and "b" are gradient viewing angles with the surface of the weave.

If the weave is observed from the point "c" direction, since the color portions 142 and 162 are not shaded by the protruding portion 122, the whole of the protruding portion 122 and the color portions 142, 162 can be observed. If the weave is observed from a viewing angle described as from the point "c" direction to move toward the point "a" direction or the point "b" direction, the color portion 142 or the color portion 162 may be shaded gradually by the protruding portion 122. If the viewing angle reaches to the point "a" direction or the point "b" direction, the whole of the color portion 142 or the color portion 162 is shaded by the protruding portion 122. That is, if the viewing angle comes to or goes over the point "a" direction, the whole left color portion 142 arranged at the left side of the protruding portion 122 is shaded so as not to be visible, thereby only the protruding portion 122 and the right color portion 162 can be visible. Correspondingly, if the viewing angle comes to or goes over the point "b" direction, the whole right color portion 162 is shaded not to be visible, thereby only the protruding portion 122 and the left color portion 142 are visible.

Therefore, if the weave is observed from various viewing angles or various position angles of the weave, the weave takes place visual color variations.

In this illustrated embodiment, the protruding yarn 12 of the weave 10 must be an opaque yarn to shade the color yarns 14, 16. The protruding yarn 12 may be a colorless yarn, such as a white yarn, a black yarn or a gray yarn between white and black. The protruding yarn 12 also may be a colorful yarn which has a demitint between the color yarns 14 and 16, or the protruding yarn 12 and the color yarns 14, 16 compose a gradual color.

The two color yarns 14, 16 of the weave are different color yarns. However, the two color yarns 14, 16 have color factors of hue, value and intensity, and if one factor is different, the two color yarns 14, 16 are different color yarns. For example, if the color yarn 14 is a crimson yarn and the color yarn 16 is a pink yarn, the color yarn 14 and the color yarn 16 have different colors.

Furthermore, the protruding yarn 12 the protruding yarn 12 and the two color yarns 14, 16 have properties of color, thickness, material, twist and elasticity coefficient. The properties of the protruding yarn are same with those of the two color yarns, or at least one property of the protruding yarn is different with that of the two color yarns.

Figure 7:
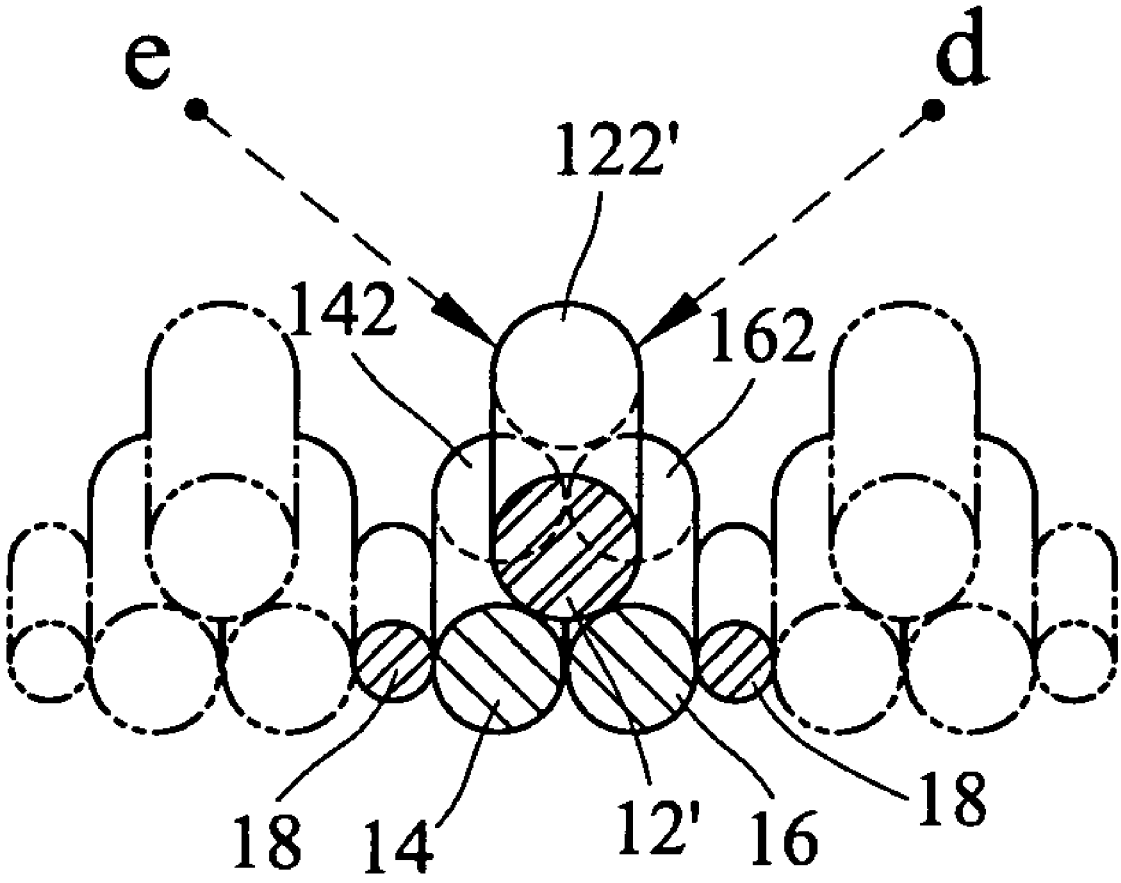
FIG. 7 is a side view of a weave with a visual color variation in accordance with a second preferred embodiment of the present invention.

Referring to FIG. 7, the weave 10 in accordance with a second preferred embodiment of the present invention is shown. The weave 10 is similar to that of the first preferred embodiment, except that the protruding yarn 12' is transparent. Since the protruding yarn 12' is transparent, the protruding yarn 12' can not shade the color yarns 14, 16 in vision. However, the color yarns 14, 16 are refracted by the protruding yarn 12' if the weave is observed from a declining viewing angle or the position angle changing by the weave inflecting. Therefore, the weave can be observed with visual color variations.

In FIG. 7, a point "d" direction or a point "e" direction is defined as a declining viewing angle observing the weave. If the weave is observed from a viewing angle described as the point "d" or "e" direction, the color portion 142 or 162 observed through the protruding portion 122, is refracted by the protruding portion 122. That is, if the weave is observed from the viewing angle described as the point "d" direction, the left color portion 142 arranged at the left side of the protruding portion 122, is refracted by the protruding portion 122 so that the left color portion 142 is evidently larger than the right color portion 162. Correspondingly, if the weave 10 is observed from a viewing angle described as the point "e" direction, the right color portion 162 arranged at the right side of the protruding portion 122 is refracted by the protruding portion 122, so that the right color portion 162 is evidently larger than the left color portion 142.

Therefore, the color portions 142, 162 are refracted by the protruding portion 122, so that the weave presents visual effects of color varying in vision, when the viewing angle changing or the position angle changing by the weave itself inflecting.

The weave 10 uses the protruding yarn 12, or 12' cooperating with the color yarns 14, 16, thereby the color portions 142, 162 may be shaded or refracted by the protruding portion 122 or 122', so that the weave 10 presents visual effects of color varying in vision if the viewing angle changes or the position viewing changes by the weave inflecting.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A weave with a visual color variation being interlaced by a plurality of longitudinal yarns and a plurality of latitudinal yarns, one of the longitudinal yarns and latitudinal yarns comprising:

at least one protruding yarn comprising a plurality of protruding portions presenting on a surface of the weave; and two color yarns with different colors being arranged beside the protruding yarn respectively, and the two color yarns having a plurality of color portions presenting on the surface of the weave respectively;

a number of separating yarns arranged between the protruding yarn and the two color yarns to separate the protruding yarn and the two color yarns;

wherein the color portions of the color yarns are shaded by the protruding portions of the protruding yarn to make the weave show various visual color variations when the weave is observed from different viewing angles;

wherein the color portions of the color yarns are refracted by the protruding portions of the protruding yarn to make the weave show various visual color variations when the weave is observed from different viewing angles.

2. The weave as claimed in claim 1, wherein the protruding yarn is an opaque yarn.

3. The weave as claimed in claim 1, wherein the protruding yarn is a transparent yarn.

4. The weave as claimed in claim 3, wherein the color portions of the color yarns are refracted by the protruding portions of the protruding yarn to make the weave show various visual color variations when the weave is observed from different viewing angles.

5. The weave as claimed in claim 1, wherein the protruding yarn and the two color yarns have properties of color, thickness, material, twist and elasticity coefficient, at least one property of the protruding yarn is different with that of the two color yarns.

6. The weave as claimed in claim 1, wherein the two color yarns have color factors of hue, value and intensity respectively, and at least one color factor of the two color yarns is different.

7. The weave as claimed in claim 1, wherein the protruding yarn is produced in response to tensile force and pulling force produced by corresponding latitudinal and longitudinal yarns intersecting with the protruding yarn.

8. A weave with a visual color variation being interlaced by a plurality of longitudinal yarns and a plurality of latitudinal yarns, one of the plurality of longitudinal yarns and the plurality of latitudinal yarns comprising:

at least one protruding yarn comprising a plurality of protruding portions presenting on a surface of the weave; and two color yarns with colors different from each other and different from the protruding yarn, the two color yarns being arranged parallel and beside the protruding yarn, wherein the protruding yarn is between the two color yarns, the two color yarns having a plurality of color portions presenting on the surface of the weave respectively, wherein the two color yarns are interlaced with one of the plurality of longitudinal yarns and the plurality of latitudinal yarns and the at least one protruding yarn is interlaced in a pattern under at least one yarn and over at least two yarns.

9. The weave as claimed in claim 8, wherein the pattern of the at least one protruding yarn is under one yarn and over three yarns.

10. The weave as claimed in claim 9, wherein the color portions of the color yarns are shaded by the protruding portions of the protruding yarn to make the weave show various visual color variations when the weave is observed from different viewing angles.

11. The weave as claimed in claim 8, wherein the protruding yarn is an opaque yarn.

12. The weave as claimed in claim 8, wherein the protruding yarn is a transparent yarn., wherein the protruding yarn is a transparent yarn.

13. A weave with a visual color variation being interlaced by a plurality of longitudinal yarns and a plurality of latitudinal yarns comprising, one of the plurality of longitudinal yarns and the plurality of latitudinal yarns comprising:

at least one protruding yarn having one color comprising a plurality of protruding portions presenting on a surface of the weave; and two color yarns with colors different from each other and different from the protruding yarn, the two color yarns being arranged parallel and beside the protruding yarn, wherein the protruding yarn is between the two color yarns, the two color yarns having a plurality of color portions presenting on the surface of the weave respectively, wherein the two color yarns are interlaced with one of the plurality of longitudinal yarns and the plurality of latitudinal yarns and the at least one protruding yarn is interlaced in a pattern wherein the plurality of protruding portion presenting on the surface of the weave are opposite to only one of the portions of the two color yarns interlaced along the same distance.

14. The weave as claimed in claim 11, wherein the color portions of the color yarns are shaded by the protruding portions of the protruding yarn to make the weave show various visual color variations when the weave is observed from different viewing angles.

15. The weave as claimed in claim 13, wherein the protruding yarn is an opaque yarn.

16. The weave as claimed in claim 13, wherein the protruding yarn is a transparent yarn, wherein the protruding yarn is a transparent yarn.

* * * * *